US006535104B1

(12) United States Patent
Koizumi

(10) Patent No.: US 6,535,104 B1
(45) Date of Patent: Mar. 18, 2003

(54) MULTI-AXIS POTENTIOMETER

(75) Inventor: David Koizumi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/675,556

(22) Filed: Sep. 29, 2000

(51) Int. Cl.[7] ..... H01C 10/00
(52) U.S. Cl. ..... 338/68; 338/74; 338/47
(58) Field of Search ..... 338/68, 71, 73, 338/114, 47, 128; 200/6 A, 6 R, 5 A; 273/148 B

(56) References Cited

U.S. PATENT DOCUMENTS

| | | | | | |
|---|---|---|---|---|---|
| 2,704,798 | A | * | 3/1955 | Gaylord et al. | 201/48 |
| 2,866,124 | A | * | 12/1958 | Giuffrida et al. | 315/13 |
| 4,027,119 | A | * | 5/1977 | Tezuka | 200/6 A |
| 4,041,439 | A | * | 8/1977 | Steddom et al. | 338/78 |
| 4,134,295 | A | * | 1/1979 | Alexander | 73/189 |
| 4,739,128 | A | * | 4/1988 | Grisham | 200/6 A |
| 4,769,517 | A | * | 9/1988 | Swinney | 200/6 A |
| 5,087,904 | A | | 2/1992 | DeVolpi | 338/128 |
| 5,317,301 | A | | 5/1994 | DeVolpi | 338/128 |
| 5,969,520 | A | * | 10/1999 | Schottler | 324/207.2 |

FOREIGN PATENT DOCUMENTS

GB 1469263 4/1977

* cited by examiner

*Primary Examiner*—Elvin Enad
*Assistant Examiner*—Kyung Lee
(74) *Attorney, Agent, or Firm*—Marger Johnson & McCollom, P.C.

(57) ABSTRACT

A multi-axis potentiometer according to this invention is capable of determining actuator movement along multiple axes. The potentiometer includes a hollow, semi-spherical shell lined internally with a resistive element. Electrical contacts are attached across from each other along the resistive element near an opening of the shell to supply a source voltage or current to the resistive element. A pair of sensors are arranged on the end of an armature to contact the resistive element. The sensors in the end of the armature are used to sense voltage or current levels at the points where they contact the resistive element. These voltage or current levels are used to determine spherical coordinates corresponding to the location of the contact point and to determine an angle of rotation of the armature relative to the resistive element. A slidable handle can further be provided to a stem of the armature. The slidable handle contains a sensor to contact a resistive element located on the stem of the armature. A source voltage or current is applied to the resistive element and the handle sensor senses a voltage or current level at a contact point between the handle sensor and the resistive element. This voltage or current level can then be used to determine a position of the handle relative to the stem, corresponding to an elevation of the handle.

23 Claims, 3 Drawing Sheets

MULTI-AXIS POTENTIOMETER

BACKGROUND OF THE INVENTION

This invention relates generally to potentiometers for use in sensing physical movement of an actuator and for converting that physical movement into analog signals that can be translated by a computer into spatial coordinates. More specifically, this invention relates to a potentiometer that can be used in a computer pointing or control device, such as a joystick or mouse, or in a manikin joint.

Traditionally, joysticks use standard one-axis potentiometers to measure relative movement and determine spatial positioning of a joystick actuator from a centering point. Specifically, in a conventional joystick, a first potentiometer, configured along one axis (i.e., an X axis), measures movement and position of the joystick actuator along that axis only. A separate potentiometer is configured along a second axis (i.e., a Y axis) to measure movement and position of the joystick actuator along that axis. A third potentiometer can also be used to measure movement and position along a third axis (i.e., a Z axis). Multiple potentiometers are therefore required to determine the spatial coordinates (X, Y, Z) corresponding to the position of the joystick actuator. Conventional joysticks are generally unable to measure an angle of rotation of the joystick actuator, and when such capability is provided, it requires the use of yet another potentiometer.

A conventional computer mouse, in general, does not contain potentiometers. Optical encoders are instead used to measure an X:Y coordinate position of the mouse. Modem mice use rotating strobe wheels that are optically read. Older mice used a special optical pad with printed lines that were read directly by optical sensors in the mouse. Relatively new force-sensing resistor based mice use miniature X:Y joysticks to determine mouse position. These devices employ a thin film force sensor which changes resistance based on pressure. This joystick responds to force only, and does not move. Except for the force-sensing resistance mouse, a computer mouse is generally unable to determine a relative position of the mouse because it lacks a fixed centering point. In a conventional computer mouse, a ball contacts two strobe wheels contained inside the mouse housing. Each of the strobe wheels is rotatably mounted within the housing and communicates with an optical encoder. Each encoder detects movement along a single axis (i.e., an X or a Y axis). As the mouse moves, friction between the ball and a surface (i.e., a mouse pad or a desk) rotates the ball. Rotation of the ball, in turn, rotates each of the strobe wheels in a direction and amount dependent on the direction and amount of mouse movement. A first encoder detects rotation of the first strobe wheel and generates an electrical signal based on the direction and amount of rotation. A second encoder detects rotation of the second strobe wheel and generates an electrical signal based on the direction and amount of rotation of that strobe wheel. These electrical signals are then sent to a computer for translation into X and Y axis displacement data, proportional to the direction and amount of physical movement of the mouse. This displacement data can then be used to control a screen pointer or to perform other desired computer operations. Conventional computer mice are generally only able to measure movement along an X, Y plane, and are further unable to detect angular movement of the mouse.

DETAILED DESCRIPTION

FIGS. 1–4 illustrate a potentiometer capable of determining actuator location along several axes according to one embodiment of this invention. These figures are not drawn to scale, but illustrate the general construction of a device according to the present invention. Most resistive elements 14 are no larger than 1" in size, as would be the case of the semi-spherical shell element 12. The desired embodiment for a toy would use a very small handle designed for the thumb and first finger. Full sized joysticks typically use a handle 4" to 6" tall for grasping by the entire hand, but for fine motor control (especially on the Z axis) a small handle grasped by a thumb and first finger would be both more ergonomic and generate more accurate results.

Figure 1:
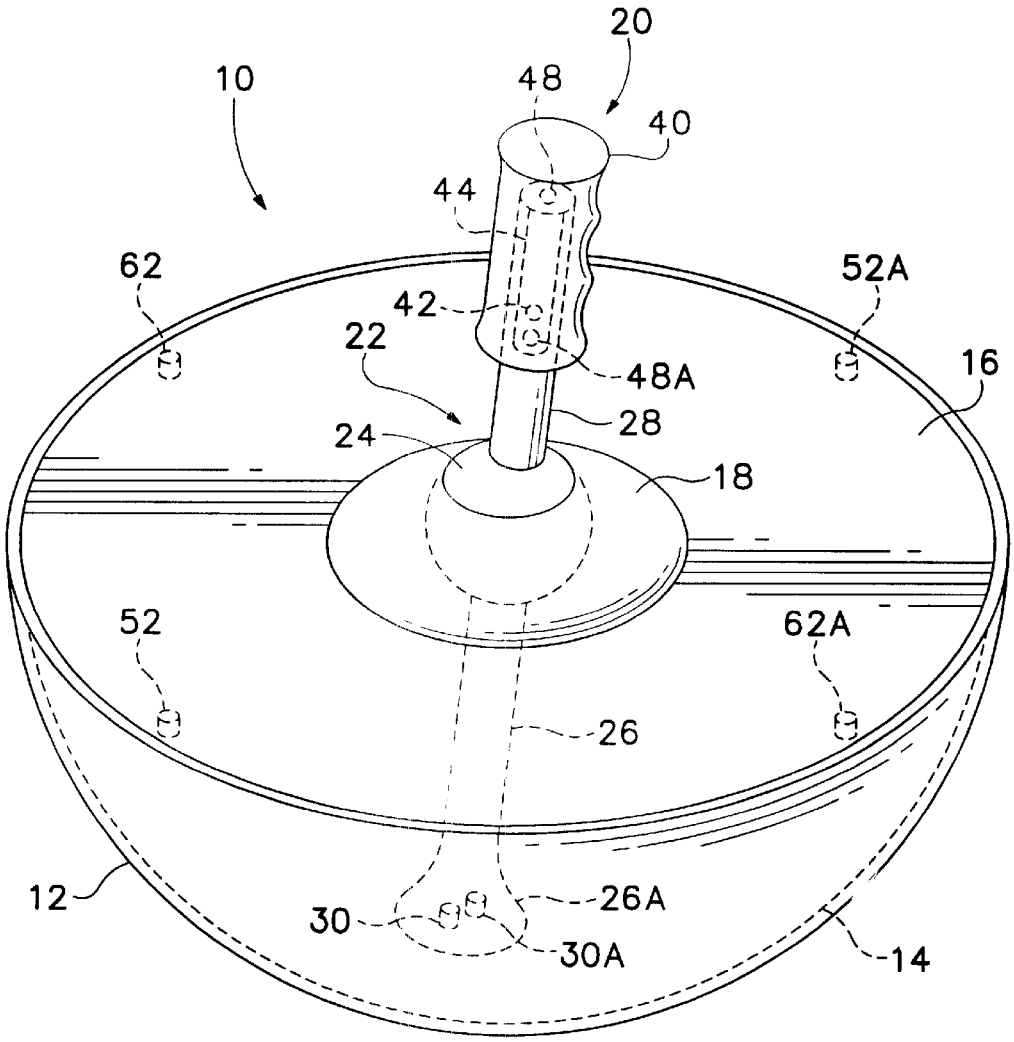
FIG. 1 is a somewhat schematic perspective view of a multi-axis potentiometer according to a preferred embodiment of the present invention.
Figure 2:
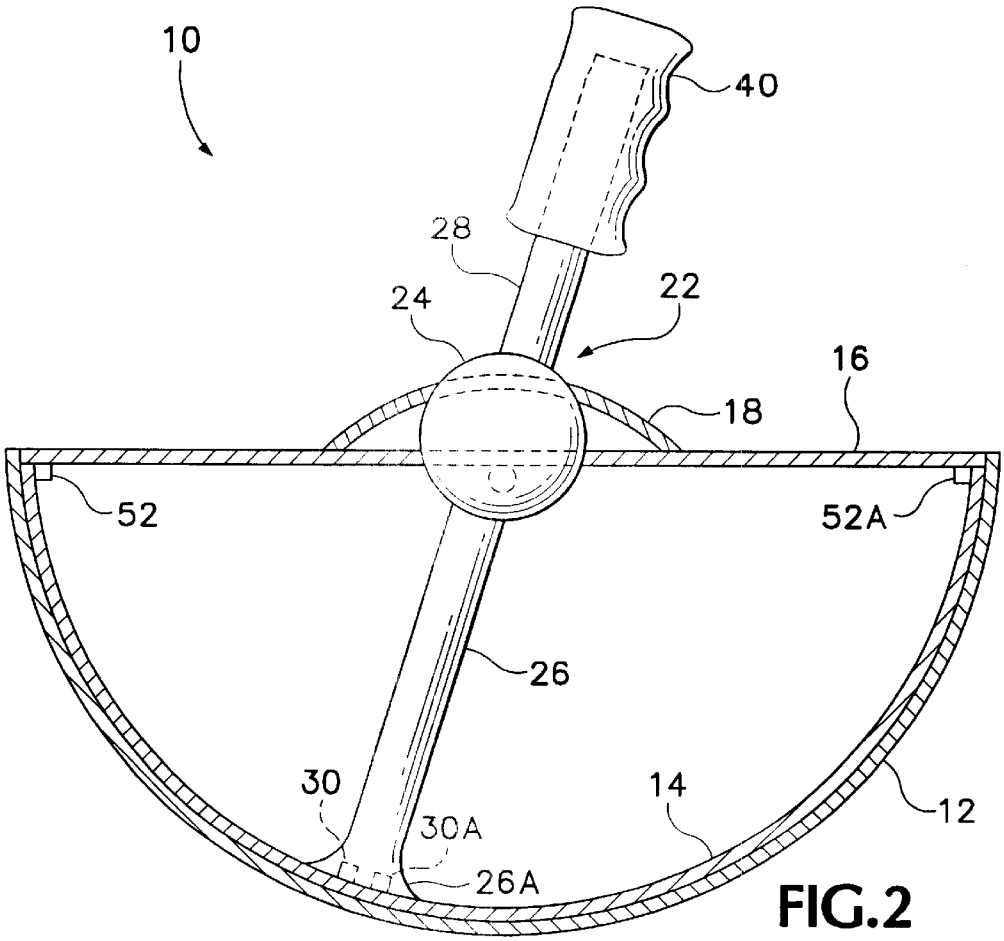
FIG. 2 is a somewhat schematic side elevation view of the multi-axis potentiometer of FIG. 1, shown in cross-section to more clearly show communication between electrical contacts and a resistive element thereof

Referring first to FIGS. 1 and 2, a multi-axis potentiometer 10, according to the preferred embodiment of this invention, includes a hollow, semi-spherical shell 12, and an actuator 20. A thin, resistive element 14, such as a carbon, plastic, ceramic, or metal film is affixed to the interior of the hollow shell 12. A cover 16 is positioned over the opening of the semi-spherical shell 12. The actuator 20 comprises a ball-joint armature 22, having a ball joint 24 arranged within a ball-joint receptacle 18 of the cover 16. A contact arm 26 extends from the ball joint 24 towards the resistive element 14 of the spherical shell 12. Two electrical sensors 30, 30A are located on the contact end 26A of the contact arm 26. The contact end 26A of the contact arm 26 is arranged to contact the resistive element 14. A sliding handle 40 is located on the stem 28 of the ball-joint armature 22. The stem 28 extends from the ball joint 24 in a direction substantially opposite the direction of the contact arm 26.

As noted above, several films can be used to provide the resistive element 14. Carbon film is the cheapest resistive film, is available in a wide range of resistances, and can be applied easily to the concave surface of the shell. Unfortunately, however, carbon film is somewhat noisy and is subject to wear. Plastic Film could also be used but is more expensive than carbon film. Like carbon film, it can be applied to complex curvatures. Plastic film is also the least noisy of the potentiometer materials. Ceramic is an expensive resistive film. It is also the most reliable, however, and is often desirable in Military equipment. Although it is somewhat noisy when the potentiometer is being rotated, it is quiet when at rest. Unfortunately, ceramic is difficult to apply to complex curvatures. Bulk metal film is another extremely expensive resistive film and is typically reserved to potentiometers used in very, very low voltage ranges where low noise is paramount. Bulk metal film is not available in a wide range of resistances, is typically only applied to flat surfaces, and is also difficult to manufacture.

The two preferred materials for the resistive elements 14 and 42 in this embodiment are plastic film and carbon film, respectively. Plastic film is preferred for the spherical curved resistive element 14 because it is reasonably cheap, can be applied to curved surfaces, and is available in useable resistance ranges. Carbon film is preferred for the sliding handle resistance element 42 because cost is an extremely important factor in a joystick, and the reliability of this film need not be as great.

Figure 3:
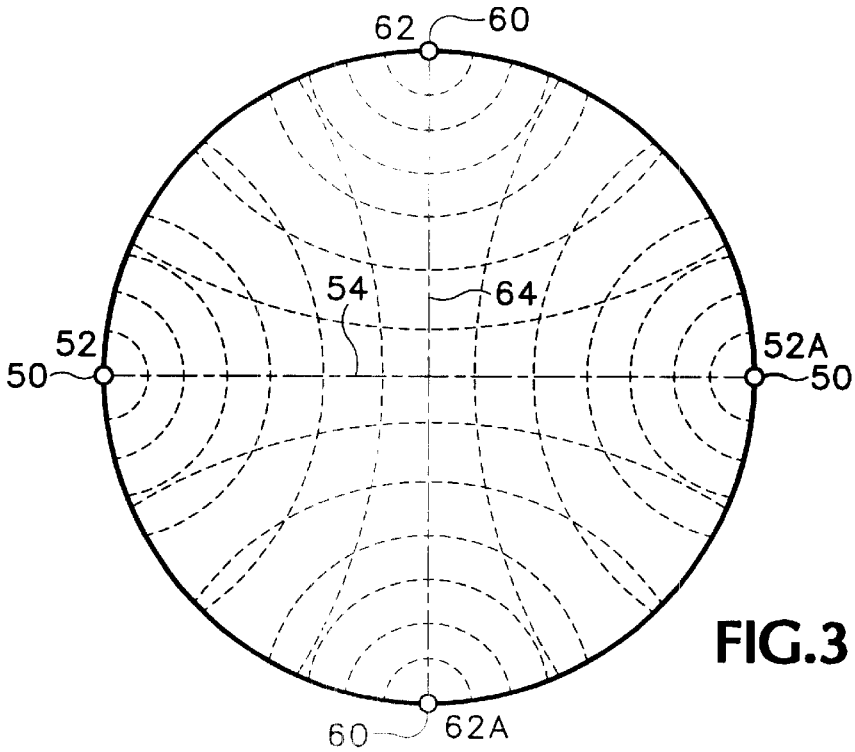
FIG. 3 is a somewhat schematic top plan view of a semi-spherical resistive element of the multi-axis potentiometer of FIG. 1, illustrating voltage (or current) equipotentials between electrical contact pairs.

FIG. 3 is a somewhat schematic top plan view of the resistive element 14 of the multi-axis potentiometer of FIG. 1 showing voltage (or current) equipotentials between first and second contacts 52, 52A, 62, 62A in the contact pairs 50, 60. Referring additionally to FIG. 3, a first electrical contact pair 50 is arranged having first and second electrical contacts 52, 52A, respectively, positioned on the resistive element 14 on opposite sides of the shell 12, near the opening thereof. A second electrical pair 60 is also arranged having first and second electrical contacts 62, 62A, respectively, positioned on the resistive element 14 on opposite sides of the shell 12, near the opening thereof. The first and second electrical contact pairs 50, 60 are further arranged such that an imaginary line 54 drawn between the first and second contacts 52, 52A in the first contact pair 50 intersects an imaginary line 64 drawn between the first and second contacts 62, 62A of the second contact pair perpendicularly at a center of the spherical shell 12.

Figure 4:
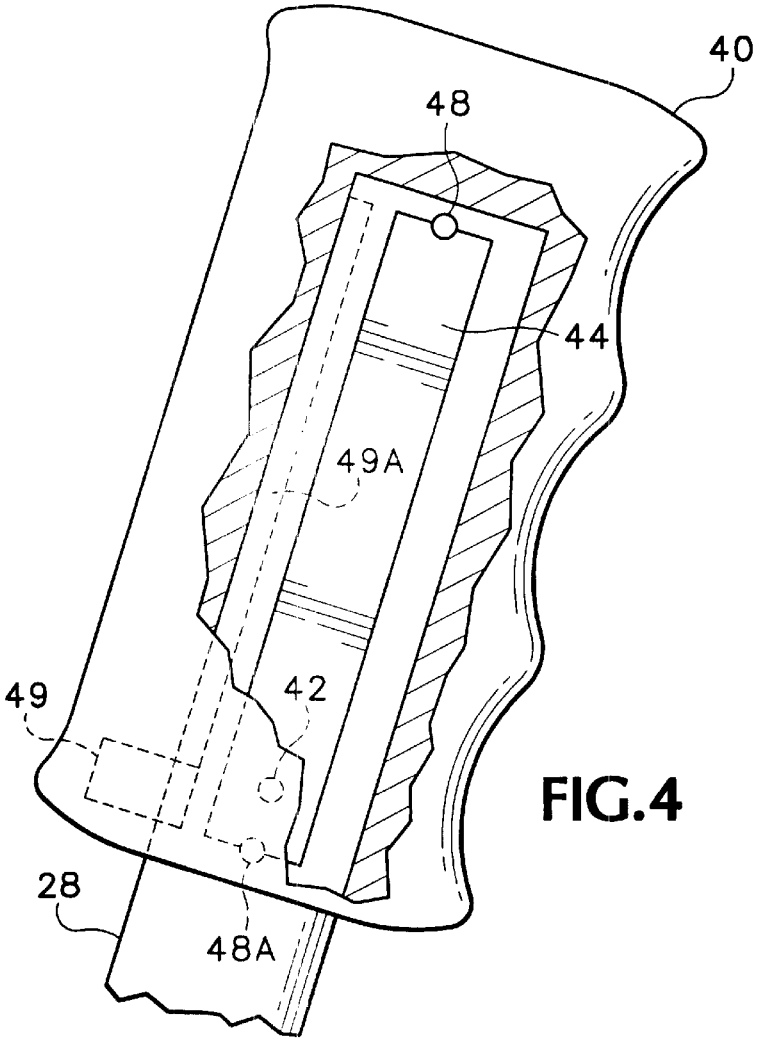
FIG. 4 is a somewhat schematic enlarged cutaway side elevation view of a sliding handle of an actuator of the multi-axis potentiometer of FIG. 1, showing a configuration thereof.

FIG. 4 is a somewhat schematic exploded side elevation view of the sliding handle 40 attached to the stem 28 of the ball-joint armature 22. Referring to FIG. 4, the sliding handle 40 allows calculation of a fourth coordinate, elevation ($\rho$). An electrical sensor 42 is located along an internal surface of the handle 40 and contacts a resistive element 44 located on the stem 28. An electrical contact pair 46 of the actuator 20 contains first and second electrical contacts 48, 48A located on opposite ends of the resistive element 44. The second electrical contact 48A is located on the resistive element 44 nearer the ball joint, while the first electrical contact 48 is located in a fixed position on the opposite end of the resistive element 44. A spline 49 and groove 49A are provided between the handle 40 and the stem 28 to prevent rotation of the handle 40 relative to the stem 28, while still allowing sliding movement of the handle 40.

In operation, the handle 40 is slidably mounted on the stem 28 and is therefore capable of longitudinal movement along the stem 28. The electrical sensor 42 of the handle 40, contacts the resistive element 44 at a contact point between the first and second contacts 48, 48A of the stem's electrical contact pair 46. Voltage (or current) is supplied to the first electrical contact 48 while the second contact 48A is attached to ground or allowed to float. The electrical sensor 42 of the handle 40, senses an amount of voltage (or current) at the contact point. In this manner, voltage or current equipotentials are supplied along the resistive element 44 that vary predictably with location, and the sensed voltage (or current) can therefore readily be used to calculate a location of the sliding handle 40 along the stem 28, and hence the elevation coordinate ($\rho$).

In operation, the electrical sensors 30, 30A, 52, 52A, 62, 62A are used to determine a location and angle of contact between the contact end 26A of the contact arm 26 and the resistive element 14 of the spherical shell 12. To accomplish this, a source voltage (or current) is applied to the first electrical contacts 52, 62 in each of the first and second contact pairs 50, 60. The second electrical contacts 52A, 62A in each of the contact pairs 50, 60 can be attached to ground or left floating. The sensors 30, 30A on the contact arm 26 are used to sense the voltage (or current) at the contact point along the resistive element 14 and thereby determine a location of the contact point.

As illustrated by dashed lines in FIG. 3, the contact pairs 50, 60, when supplied with power, yield voltage or current equipotentials along the resistive element 14. In operation, the contact pairs 50, 60 are alternately supplied with power so that only one set of voltage or current equipotentials exists on the resistive element at any given time. The voltage or current equipotentials generated by each contact pair 50, 60 are sensed by the sensors 30, 30A in the contact end 26A of the contact arm 26. Because the voltage or current varies predictably between the contacts in each contact pair 50, 60 along the resistive element 14, the sensed voltage or current for the two contact pairs 50, 60 can readily be used to calculate spherical coordinates (latitude ($\phi$) and longitude ($\theta$)) corresponding to a location of a point of contact between the contact end 26A of the arm 26 and the resistive element 14. Furthermore, the use of two separate sensing sensors 30, 30A on the contact end 26A allows the calculation of an angular position (or angle of rotation ($\omega$)) of the ball-joint armature 22 by comparing the voltage or current measurements sensed by each sensor 30, 30A.

Figure 5:
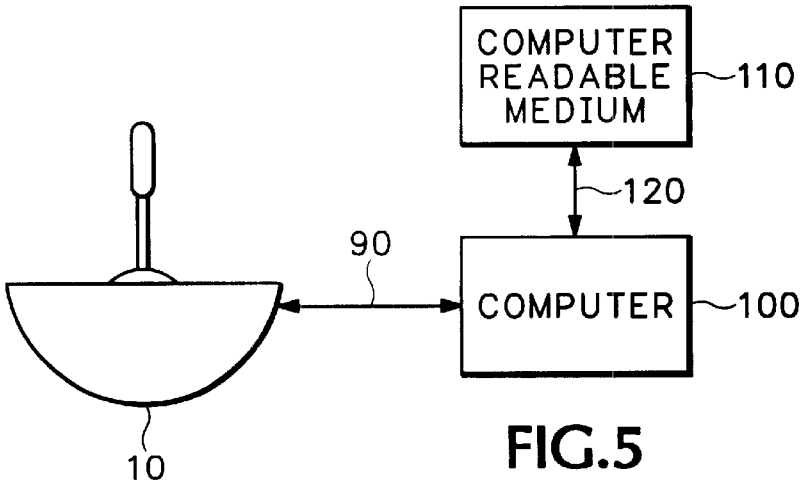
FIG. 5 is a block diagram illustrating a computer and a computer readable medium for receiving and translating electrical signals from the potentiometer of FIG. 1, according to another aspect of this invention.

As described above, the multi-axis potentiometer according to a preferred embodiment of this invention makes use of only two moving parts, the ball-joint armature 22 and the sliding handle 40, to provide measurements of four coordinates ($\phi$, $\theta$, $\rho$, $\omega$). Referring to FIG. 5, a microcomputer or a PC 100 can be used to perform the contact switching to measure the nonlinear resistances corresponding to the spherical coordinates ($\phi$, $\theta$), and to receive and translate the spherical coordinates into planar coordinates (X, Y). The microcomputer or PC 100 can also be used to map the elevation ($\rho$) directly into the planar coordinate (Z) and the angle of rotation ($\omega$) into a planar angle of rotation ($\omega_p$). Electrical signals 90 corresponding to the location and position of the sensors are transmitted from the potentiometer 10 to the computer 100. A computer readable medium 110 contains the instructions 120 for directing the computer 100 to translate the electrical signals 90 into the desired coordinates.

As should be readily apparent to those of skill in the art, this invention is useful for any type of device that requires the determination of spatial coordinates based on movement of an actuator. Such devices may include, for example: joysticks, computer mice, manikin joints, or other types of pointing devices for computers or positional sensors, among other things. Having described and illustrated the principles of the invention in a preferred embodiment thereof, it should also be apparent that the invention can be modified in arrangement and detail without departing from such principles. I claim all modifications and variations coming within the spirit and scope of the following claims.

What is claimed is:

1. A multi-axis potentiometer, comprising:

a body having a resistive element;

an actuator that moves with respect to three or more axes;

a contact arm that moves in response to movement of the actuator; and an electrical sensor positioned on an end of the contact arm, said electrical sensor contacting the resistive element to sense a voltage or current at a contact point, wherein said sensed voltage or current corresponds to a location of the contact point with respect to three or more axes.

2. A potentiometer according to claim 1, wherein said resistive element is supplied with a source voltage or current.

3. A potentiometer according to claim 2, wherein the source voltage or current is provided between two electrical contact pairs arranged along the resistive element such that imaginary lines drawn directly between contacts of each contact pair intersect at approximately a center of the resistive element.

4. A potentiometer according to claim 1, wherein the electrical sensor of the contact arm comprises a sensor pair adapted to permit determination of an angle of rotation of the contact arm about a longitudinal axis of the contact arm.

5. A potentiometer according to claim 1, wherein the three or more axes comprise a longitudinal axis, a latitudinal axis, and a longitudinal axis of the contact arm.

6. A computer readable medium comprising instructions for translating electrical signals corresponding to the three or more axes from the potentiometer of claim 1 into spatial coordinates.

7. A multi-axis potentiometer, comprising:

a body having a resistive element, said resistive element being supplied with a source voltage or current;

an actuator capable of movement with respect to multiple axes, wherein said actuator comprises a stem comprising an additional resistive element longitudinally aligned along a portion of a length of the stem, said additional resistive element comprising first and second electrical contacts disposed on opposite longitudinal ends thereof, and a handle slidably mounted on the stem, said handle comprising an additional electrical sensor configured to contact the additional resistive element at a contact point on the additional resistive element between the first and second electrical contacts;

a contact arm configured to move in response to movement of the actuator; and an electrical sensor positioned on an end of the contact arm, said electrical sensor arranged to contact the resistive element and to sense a voltage or current at a contact point, wherein said sensed voltage or current corresponds to a location of the contact point.

8. A potentiometer according to claim 7, wherein the first electrical contact is connected to a source voltage or current and wherein the second electrical contact is connected to a ground or left floating and wherein the electrical sensor of the handle is adapted to sense a voltage or current at the contact point on the additional resistive element.

9. A multi-axis potentiometer, comprising:

a body having a resistive element, said resistive element being supplied with a source voltage or current between two electrical contact pairs arranged along the resistive element, wherein the two contact pairs alternately supply the source voltage or current to the resistive element;

an actuator that moves with respect to multiple axes;

a contact arm that moves in response to movement of the actuator; and an electrical sensor positioned on an end of the contact arm, said electrical sensor contacting the resistive element to sense a voltage or current at a contact point, wherein said sensed voltage or current corresponds to a location of the contact point.

10. A potentiometer according to claim 9, wherein the potentiometer is adapted to permit the determination of coordinates corresponding to the location of the contact point with respect to three or more axes.

11. A multi-axis potentiometer, comprising:

a semi-spherical shell comprising a resistive element disposed along an inner surface thereof;

an electrical contact pair having first and second electrical contacts disposed on substantially opposite sides of the resistive element, said contact pair adapted to supply a source voltage or current across the resistive element; and an armature comprising an actuator and a contact arm, wherein said contact arm moves in response to actuator movement, said contact arm comprising a contact end having an electrical sensor that contacts the resistive element at a contact point to sense a voltage or current at the contact point, and wherein said actuator comprises a stem and a handle, said stem disposed substantially opposite the contact arm on the armature and comprising an additional resistive element and an electrical contact pair, said electrical contact pair disposed on opposite ends of the additional resistive element to supply a source voltage across the additional resistive element; and said handle comprising an electrical sensor, said handle sidably mounted on the stem of the armature, said electrical sensor contacting the additional resistive element at a contact point on the additional resistive element to sense a voltage at the contact point on the additional resistive element.

12. A multi-axis potentiometer according to claim 11, wherein said armature moves in relation to three or more axes.

13. A computer readable medium containing instructions for causing a computer to receive an electrical signal representative of the voltage or current at the contact points on the resistive element and additional resistive element from the multi-axis potentiometer of claim 11, and further configured to determine a spherical coordinate and a handle position based on the electrical signal therefrom.

14. A computer readable medium according to claim 13, further configured to translate the spherical coordinate into a planar coordinate.

15. A potentiometer, comprising:

a shell having a resistive element located along an internal surface thereof, said resistive element being supplied with a source voltage or current;

an electrical sensor positioned on an end of a contact arm, said electrical sensor arranged to contact the resistive element of the shell at a shell contact point and to sense a voltage or current at the shell contact point, wherein said sensed voltage or current corresponds to a location of the shell contact point;

a stem comprising a resistive element longitudinally aligned along a portion of a length of the stem, and said resistive element comprising first and second electrical contacts disposed on opposite longitudinal ends of the resistive element; and a handle slidably mounted on the stem, said handle comprising an electrical sensor configured to contact the resistive element at a stem contact point between the first and second electrical contacts.

16. A potentiometer according to claim 15, wherein the first electrical contact is connected to a source voltage or current and wherein the second electrical contact is connected to a ground or left floating and wherein the electrical sensor of the handle is adapted to sense a voltage or current at the stem contact point.

17. A potentiometer according to claim 15, wherein the source voltage or current is provided between two electrical contact pairs arranged along the resistive element such that imaginary lines drawn directly between contacts of each contact pair intersect at approximately a center of the shell.

18. A potentiometer according to claim 17, wherein the two contact pairs are configured to alternately supply the source voltage or current to the resistive element.

19. A multi-axis potentiometer, comprising:

a shell comprising a resistive element;

an armature comprising a contact arm having an electrical sensor that contacts the resistive element at a contact point; and a handle comprising an electrical sensor, said handle slidably mounted on the armature, said armature comprising a resistive element that is contacted by the handle electrical sensor at a handle contact point.

20. A potentiometer according to claim 19, wherein the potentiometer communicates with a microprocessor that translates voltages or currents measured by the electrical sensors at the contact points into data coordinates corresponding to a location of the contact points.

21. A potentiometer according to claim 19, wherein the electrical sensor of the contact arm comprises two or more sensors that provide data regarding an angle of rotation of the contact arm around a longitudinal axis thereof.

22. A potentiometer according to claim 19, wherein the electrical sensor of the contact arm is configured to sense a position with respect to three or more axes.

23. A potentiometer according to claim 22, wherein the three or more axes comprises a lateral axis and a longitudinal axis of the shell and a longitudinal axis of the contact arm.

* * * * *